United States Patent [19]

Via Cava

[11] Patent Number: 5,040,756

[45] Date of Patent: Aug. 20, 1991

[54] NURSING APPARATUS WITH NON-TANGLING TUBE

[76] Inventor: Neal Via Cava, 613 Benton Ave., Morrisville, Pa. 19067

[21] Appl. No.: 525,402

[22] Filed: May 18, 1990

[51] Int. Cl.[5] ..... A47D 15/00

[52] U.S. Cl. ..... 248/103; 248/313

[58] Field of Search ..... 248/102, 103, 104, 105, 248/106, 107, 313, 311.3, 235, 301, 302, 307; 215/11.1; 222/335; 285/235, 301, 302, 307; 211/88, 75

[56] References Cited

U.S. PATENT DOCUMENTS

| | | | |
|---|---|---|---|
| 2,634,112 | 4/1953 | Snow | 248/311.3 X |
| 3,874,007 | 4/1975 | Dolan | 248/311.3 X |
| 4,030,690 | 6/1977 | Hanaver | 248/104 X |
| 4,295,619 | 10/1981 | Kulin | 248/311.3 X |
| 4,326,648 | 4/1982 | Kieber | 248/311.3 X |
| 4,463,859 | 8/1984 | Greene | 248/103 X |
| 4,648,572 | 3/1987 | Sokoi | 248/206.3 X |
| 4,776,617 | 10/1988 | Sato | 285/302 X |
| 4,810,008 | 3/1989 | Brodie | 285/235 X |

*Primary Examiner*—J. Franklin Foss

*Attorney, Agent, or Firm*—Daniel Kramer

[57] ABSTRACT

Apparatus for feeding infants especially adpated for use in vehicles such as automobiles, buses, airplanes or other conveyances. The apparatus comprises a container for a liquid food such as milk and a bracket adapted to hold the container. The bracket is equipped with suction cup and hanger means for securely supporting the bracket from the vehicle interior. A fitting, including a manual valve having an inlet and an outlet is positioned at the container outlet and adapted for leak-tight communication with the container outlet for the dual purposes of making a connection to the container and for controlling flow from the container. A first short length of flexible tubing provides flow communication from the valve outlet. A nipple, adapted for insertion in the infant's mouth and having a flow passage, is provided. A second short length of flexible tubing is connected to the nipple for providing flow communication to the nipple. A substantially straight rigid conduit is connected to the first and second short lengths of flexible tubing for providing non-tangling flow communication between the milk container and the nipple.

8 Claims, 4 Drawing Sheets

FIG. 10
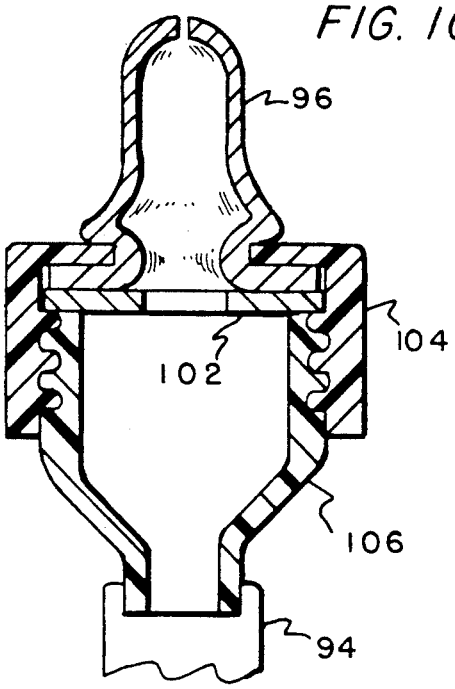
FIG. 11
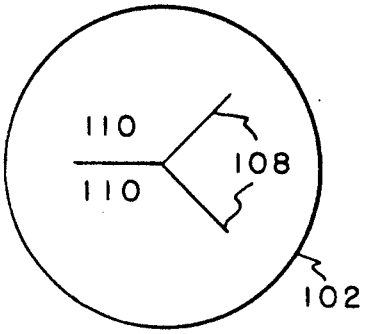
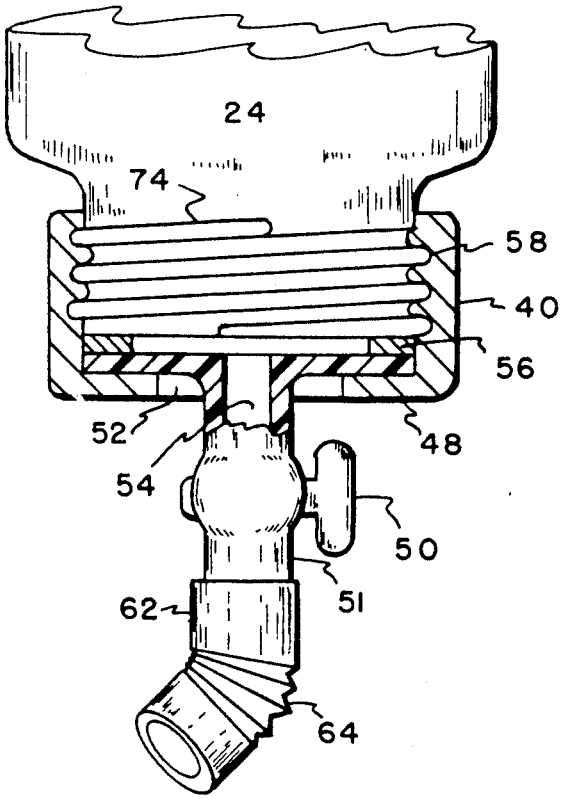
FIG. 12

NURSING APPARATUS WITH NON-TANGLING TUBE

FIELD OF THE INVENTION

The present invention relates to apparatus for containing and for delivering liquid food or refreshment from a container to an infant via a conduit connecting the container to a nipple. The present invention further relates to such apparatus including means for supporting the container remotely from the infant, as by attachment to a portion of a vehicle in which the infant is being conveyed. The present invention further relates to such apparatus in which a portion of the conduit for conveying the liquid food or refreshment to the infant is rigid to prevent the conduit from becoming entangled with the infant or itself.

BACKGROUND OF THE INVENTION

Infants and seriously ill patients who must be fed with liquids have recourse to nursing apparatus common to infant feeding. In this specification the term infant, unless otherwise specified, will be used uniformly to refer to all manner of organisms to which my invention might be applied including but not limited to human infants, adults or aged who are paralyzed, injured or disabled from any or no cause or who are physically restrained, and non human animals. The term milk will be used throughout this specification, unless otherwise specified, to apply to any sort of liquid which may be required or desired to be delivered to an infant, including but not restricted to liquids such as milk, juice of fruits or vegetables, solutions or suspensions of nutrients or pharmaceuticals in aqueous or other media, water or any other material than can be delivered by force of gravity or externally applied pressure including atmospheric air pressure, to an infant.

Nursing apparatus, which is well known to parents and to others responsible for the feeding of infants, generally consists of a container for holding the milk and a cap for the container which includes a soft rubber protruding portion or nipple, fabricated with a hole in the end of the protruding portion, as an integral or separate part of the cap. The milk is fed from the container, through the nipple, into the mouth of the sucking infant.

Typically, a parent will hold the feeding infant and the container, actively positioning and repositioning the container and its attached nipple to keep the nipple inserted into the infant's mouth. Since the filled container is relatively heavy and difficult to support without the nipple slipping out of the infant's mouth, stratagems have been developed to allow the infant to be fed without holding either the infant or the container. One stratagem involves strapping the container to a sandbag structure heavy enough to keep the container in a relatively fixed position with respect to the crib in which the infant lays. Should the infant change position, the container with its rigidly attached nipple cannot follow and the nipple slips out of the infant's mouth, an event soon followed by its anguished screams of rage at its having lost contact with the nipple.

Other stratagems include remote feeders generated by fixing the position of the container with respect to the infant's crib or bed at about the same elevation as the infants's head or higher and connecting the container to a remote nipple by a flexible tube. The nipple, having only its own slight weight plus the slight weight of the adjacent connecting tube and its contents, could be retained by the infant in her mouth with ease, despite her own motion. The container has its position fixed by means of hooks or clamps or suction cups allowing it to be securely positioned with respect to a support structure such as a crib side or an auto window.

The presence of a long flexible tube has generated parents fears that the infant could become entangled with the tube causing it distress or harm. My invention is directed toward a non-tangling, non-strangling improvement in remote feeders.

SUMMARY OF THE INVENTION

Briefly stated the present invention comprises a nursing apparatus for feeding milk to a suckling infant. The nursing apparatus includes a liquid container having a flexible outlet conduit, said outlet conduit having a first length, and a nipple having a flexible inlet conduit, said inlet conduit having a second length. The nursing apparatus further includes a rigid conduit having a third length and an inlet and an outlet, said rigid conduit connecting the flexible outlet conduit and the flexible inlet conduit, whereby milk is conveyed from the container to the nipple without danger of any conduit becoming tangled either with the infant or with itself.

BRIEF DESCRIPTION OF THE DRAWINGS

The foregoing summary, as well as the following description of the preferred embodiments, will be better understood when read in conjunction with the appended drawings. For the purpose of illustrating the invention, there is shown in the drawings an embodiment which is presently preferred, it being understood, however, that the invention is not limited to the specific instrumentalities or the precise arrangement of elements disclosed.

FIG. 10 is a side elevational view in partial cross section of a union for joining the flexible tube to the nipple including a vacuum actuated valve disc.

FIG. 11 is a plan view of the vacuum actuated valve disc.

FIG. 12 is a side elevational view in partial cross section of the milk container with its valved union connector to a flexible conduit.

DETAILED DESCRIPTION OF THE INVENTION

Figure 1:
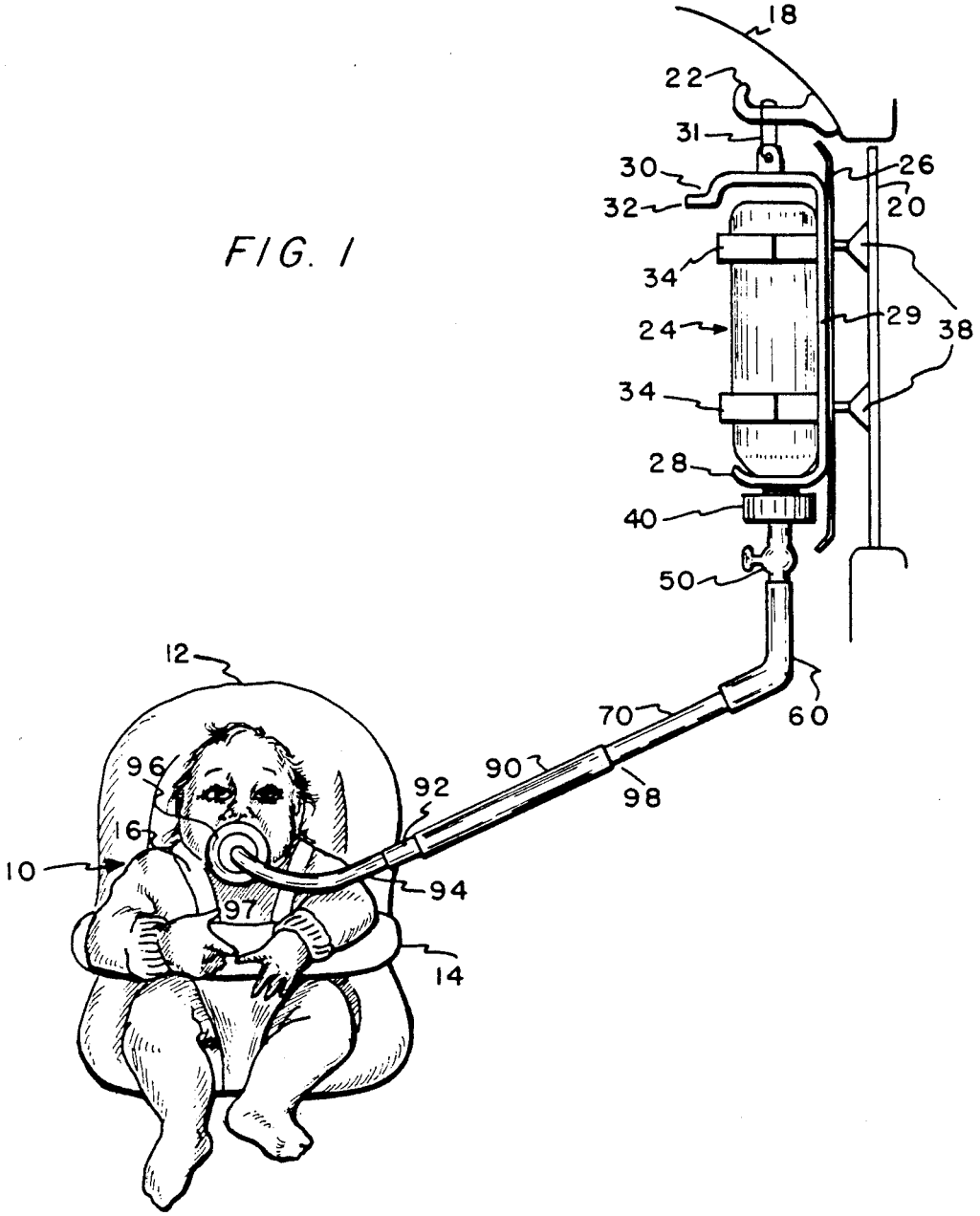
FIG. 1 is a front elevation of an embodiment of the present invention showing it installed in a vehicle with the infant being fed, secured in a car safety seat.

Referring now to the drawings, wherein like references are used to indicate like elements, there is shown in FIG. 1 a front elevation of an embodiment of the present invention showing it installed in a vehicle 18 secured both with suction cups 38 to window 20 and with loop 31 from clothes hook 20 which hook is factory installed and fastened to vehicle 18.

The infant 10 being fed is secured in a car safety seat 12 and retained by lap belt 14 and crotch-chest strap 16. Container 24, having inside a supply of cold milk, is secured in place in bracket 29 by straps 34 and forked lower support 28. Sun shade 26, fabricated from an opaque and reflective material such as aluminum foil laminated with a cloth, paper or plastic backing for strength, is positioned to prevent direct sun rays traversing the window 20 from impinging on and thereby unnecessarily warming the milk within the container 24. A more detailed description of bracket 29 is provided in connection with FIG. 2.

Within the milk flow path is first rigid conduit 90 having a larger diameter which is tellescopingly mated with a second rigid conduit 70 having a smaller diameter, at telescoping joint 98, to be described in more detail in connection with discussion of FIGS. 6 and 7. Typically the rigid conduits are fabricated from a thermoplastic such as high density polyethylene or polystyrene though other plastics and even paper/plastic laminates or composites having the required properties of strength and rigidity may be employed.

The inlet end of smaller rigid conduit 70 is connected by slip-on fit to short flexible tube 60 which in turn is connected to valve 50 positioned at the flow connection outlet of container 24. The outlet end of larger rigid tube 90 is connected by slip-on fit to short flexible tube 94 which in turn provides flow communication to nipple 96. Typically the flexible tubes are formed of natural rubber though any of the flexible plastics such as polyvinylchloride or low density polyethylene wil serve equally well.

The length of the telescoping tube assembly 70, 90 is adjusted by the user to match the distance from the container to the infant, thereby substantially eliminating any slack. A lightweight support 97 is employed to position the nipple in front of the infant so that it will not fall when released from the infant's mouth and so she can reach for it by a slight forward head motion, thereby eliminating much crying and fussing since no attention from a parent is required once the nipple is properly positioned in front of the infant.

Figure 2:
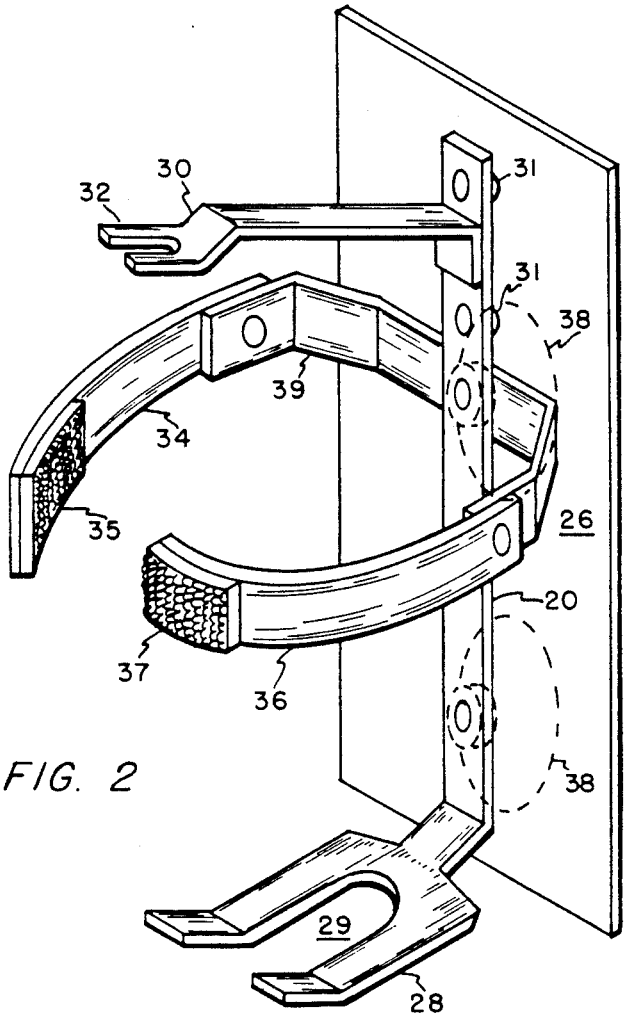
FIG. 2 is an isometric view of the bracket for the milk container including a retaining strap having a hook-and-loop closure, and sun screen.

FIG. 2 shows in isometric view the bracket 29 having lower fork 28 connected to support column 20. The milk container 24, not shown, is strapped in place by means of flexible straps 34, 36. Typically straps 34, 36 are fastened together to securely hold the milk container 24 by a hook portion of a hook and loop fastener pair attached as by sewing or adhesive to the inside end of strap 34 and a loop portion of the hook and loop fastener pair attached in the same way at the outside end of strap 36. The strap ends opposite the hook and loop fasteners are fastened by rivets or adhesive to cradle 39. Cradle 39, in turn is secured to support column 20 by means such as rivets or spotwelding. In the alternative, the entire bracket can be formed from one piece of plastic by injection molding.

Figure 3:
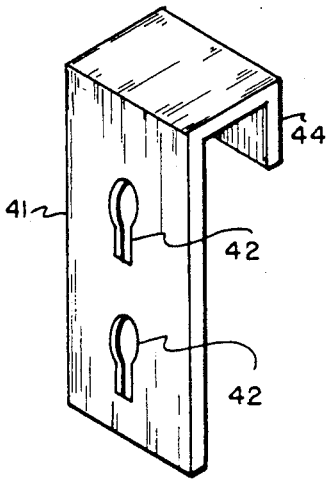
FIGS. 3, 4 and 5 shoow details of alternate channel and hook type hanging means and a side elevation of the top portion of the vertical bracket member of FIG. 2 with rivet means for engaging the alternate hanging means, respectively.
Figure 4:
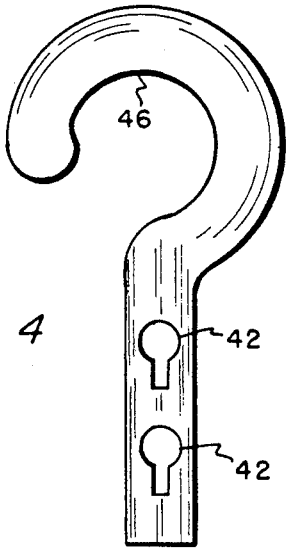
Figure 5:
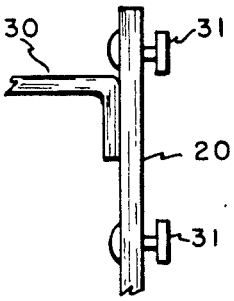

Alternate modes of supporting the bracket with its milk container 24 within the vehicle or from the crib side are illustrated. Suction cups 38 are provided to securely fasten the bracket to the car window 20. Protruding rivets 31 positioned at the top of support column 20 and shown more clearly in FIG. 5 are employed to engage alternate hanger forms, examples of which are the channel type shown in FIG. 3 and the hook type of FIG. 4. The rivet heads 31 of FIG. 5 are manually inserted through the keyholes 42 in the alternate hanger forms of FIGS. 3 and 4 and pulled upward to secure a firm connection.

A top portion 30 of bracket 29 is formed with fork 32 sized to accept, with resistance, flexible tube portion 94 adjacent nipple 96. When it is desired to remove the apparatus from use, flexible tube portion 94, adjacent nipple 96, is simply pressed into fork 32 thereby securely holding the tube 94 and the nipple 96 out of the way and preventing the nipple 96 from falling into an unsanitary position.

Figure 6:
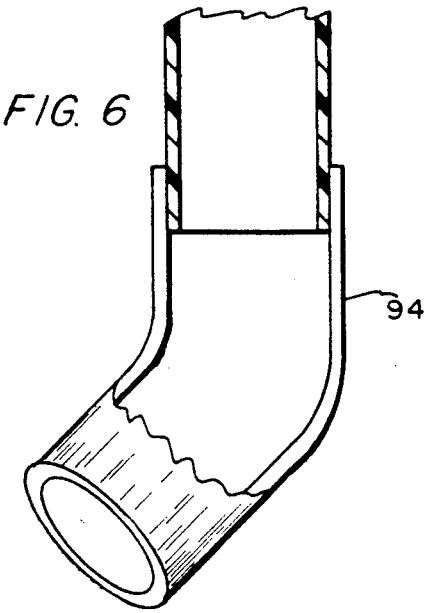
FIG. 6 is a side elevational view in partial cross section of a rigid conduit having a telescoping joint.

FIG. 6 illustrates in cross sectional view one construction of the telescoping joint between the smaller rigid tube 70 and larger rigid tube 90. An outwardly turned flange 72 is provided in the end of the smaller rigid tube 70. Positioned on tube 70 just above flange 72 is soft rubber gasket 74, which is selected to provide a leaktight yet sliding fit between the inner bore of larger rigid tube 90 and the outer surface of smaller rigid tube 70. An inwardly turned flange 92 at the end of larger rigid tube 90 is provided to prevent the gasket 74 from sliding or being pulled out of the end of the larger rigid tube 90. Typically rigid tube 90 has a outside diameter of 0.3125 (5/16) inches (7.94 mm) with a wall thickness of 0.012 inches (0.305 mm). Typically rigid tube 70 has an outside diameter of 0.250 ($\frac{1}{4}$) inches (6.35 mm) with a wall thickness of 0.010 inches (0.254 mm). Other tube diameters and wall thicknesses may be employed as availability and cost of materials dictate.

Figure 7:
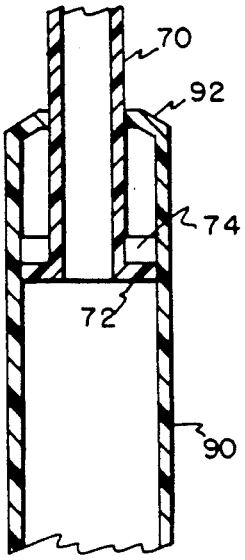
FIG. 7 is a side elevational view in cross section of an alternate construction of the telescoping joint.
Figure 7:
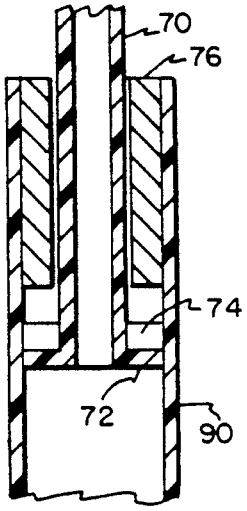

In FIG. 7 an alternate construction is employed wherein sleeve 75, formed of a relatively rigid material such as polstyrene, is provided to maintain the inner tube 70 and the outer tube 90 in coaxial relationship.

Figure 8:
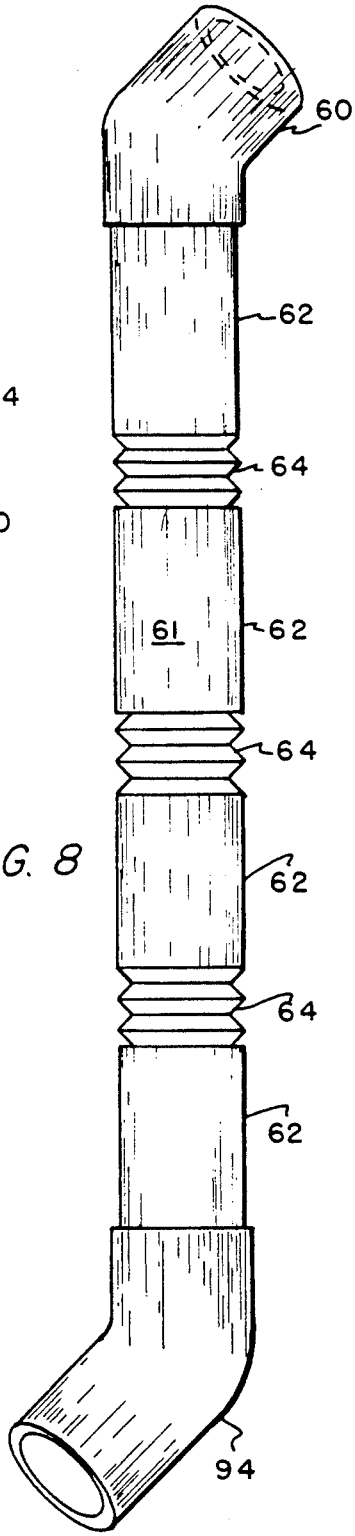
FIG. 8 is a side elevational view of a rigid conduit having corrugated semi-flexible portions interposed between its ends.

FIG. 8 shows a semi-rigid tube assembly 61 having limited flexibility provided by flexible elements 64 positioned at intervals along the length of semi-rigid tube assembly 61. The resulting semi-rigid tube assembly 61 comprising alternating rigid elements 62 and flexible elements 64 can be employed to substitute for both the rigid telescoping tubes 70 and 90 and the short flexible tubes 60 and 94 of of FIGS. 1, 6 and 7. The flexible elements 62 may be either smooth or corrugated. The length of semi-rigid assembly 61 can be adjusted by simply cutting the semi-rigid tube assembly 61 to the desired length, discarding the excess. In an alternative, the manufacturer may simply produce and make different lengths available. Because of the simplicity and low cost of this design, the entire semi-rigid assembly can be discarded after each use, instead of being retained and cleaned for re-use. Typically, the diameter of the rigid elements 64 is 0.25 inches (6.35 mm); the wall thickness is 0.0075 inches (0.19 mm) and the ratio of the total length of the rigid elements to the total combined length is greater than 0.25, although other tube diameters, wall thicknesses and ratios may be selected to fit other circumstances.

Figure 9:
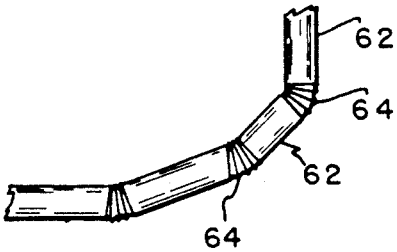
FIG. 9 is a side elevational view of the rigid member of FIG. 8 in a slightly bent condition.

FIG. 9 shows the limit of bending to which the partly corrugated rigid tube of FIG. 8 can be formed, illlustrating that the partly corrugated rigid tube cannot be entangled with the infant or itself.

FIG. 10 shows one construction of an assembly which includes nipple 96, outer female threaded coupling 104 and inner threaded male reducing coupling 106. The reduced portion of the reducing coupling 106 engages the end of flexible tube 94 which provides flow communication with rigid tube 90 of FIG. 1. The enlarged end of the reducing coupling screws into the female threaded portion 104 thereby providing a leak-tight joint between tube 94 and nipple 96. Flat valve disk 102 is clamped between the flange of nipple 96 and the enlarged end of the reducing coupling 96 to allow flow to the nipple 96 only when the pressure on the nipple side has been reduced by the infant's sucking action.

FIG. 11 shows a plan view of the valve disc 102 which is fabricated of surgical rubber or similar material and typically is 1.2 inches (30.5 mm) in diameter and 0.060 inches (1.52 mm) thick. Valve disc 102 employs three slits 108 each slit 0.375 (⅜) inches (9.5 mm) long, spaced apart at 120 degree angles, thereby dividing the central portion into three valve tabs 110. When no sucking action takes place, the tabs 110 seal together preventing unintended flow or leakage of milk. When the infant sucks, the pressure on the nipple side is reduced and the tabs 110 deflect toward the nipple, creating an opening through which milk flows to the nipple.

FIG. 12 illustrates the bottom of container 24 having an opening including external threads 74. Cap 40, having internal threads 58 matching the external threads of container 24, screws down on gasket 56 thereby sealing the flange 52 of the outlet connection containing manual valve 50 to the neck of container 24. Valve 50 is employed to manually regulate and, if necessary, to shut off flow from the container when it is desired to remove the tubing for cleaning or disposal. A rigid portion 62 of the semi-flexible tube of FIG. 8 is directly attached to the outlet spud 51 of valve 50.

From the foregoing description, it can be seen that the present invention comprises an improved remote nursing system including a non-tangling conduit and other features. It will be appreciated by those skilled in the art that changes could be made to the embodiments described in the foregoing description without departing from the broad inventive concept thereof. It is understood, therefore, that this invention is not limited to the particular embodiment or embodiments disclosed, but is intended to cover all modifications which are within the scope and spirit of the invention as defined by the appended claims.

I claim:

1. A nursing apparatus for feeding liquid food to a suckling infant comprising:

a. a liquid container having a flexible outlet conduit, said outlet conduit having a first length, b. a nipple having a flexible inlet conduit, said inlet conduit having a second length, c. and a rigid conduit haveing a third length and an inlet and an outlet, said rigid conduit connecting said flexible outlet conduit and flexible inlet conduit, whereby liquid is conveyed from the container to the nipple without danger of any conduit becoming tangled either with the infant or with itself.

2. A nursing apparatus as recited in claim 1, further including bracket means for holding the container, said bracket means being adapted to be securely attached to a support.

3. A nursing apparatus as recited in claim 2 where the support is part of a vehicle.

4. A nursing apparatus as recited in claim 1 where the total length of the rigid conduit is greater than 25% of the sum of the lengths of the rigid and the flexible conduits.

5. A nursing apparatus as recited in claim 2, said apparatus being capable of being positioned subject to a source of radiant thermal energy, further including shield means attached to the bracket for preventing radiant energy from the radiant energy source from reaching the container.

6. A nursing apparatus as recited in claim 1 where the configuration of the flexible inlet and the flexible outlet conduits are selected from the group consisting of smooth and corrugated.

7. A nursing apparatus as recited in claim 1 where the length of the rigid conduit is adjustable.

8. A nursing apparatus as recited in claim 7 where the adjustable rigid conduit includes an inlet rigid section including the inlet, an outlet rigid section including the outlet, and a telescoping joint axially joining the inlet rigid section and the outlet rigid section.

* * * * *